US008684692B2

(12) United States Patent
Mayer et al.

(10) Patent No.: US 8,684,692 B2
(45) Date of Patent: Apr. 1, 2014

(54) COOLED SNUBBER STRUCTURE FOR TURBINE BLADES

(75) Inventors: Clinton A. Mayer, Tequesta, FL (US); Christian X. Campbell, Oviedo, FL (US); Andrew Whalley, Jupiter, FL (US); John J. Marra, Winter Springs, FL (US)

(73) Assignee: Siemens Energy, Inc., Orlando, FL (US)

( * ) Notice: Subject to any disclaimer, the term of this patent is extended or adjusted under 35 U.S.C. 154(b) by 597 days.

(21) Appl. No.: 13/023,651

(22) Filed: Feb. 9, 2011

(65) Prior Publication Data

US 2011/0194943 A1 Aug. 11, 2011

Related U.S. Application Data

(63) Continuation-in-part of application No. 12/701,041, filed on Feb. 5, 2010, now Pat. No. 8,523,525.

(51) Int. Cl.
*F01D 5/18* (2006.01)
*F01D 5/22* (2006.01)

(52) U.S. Cl.
USPC ..... 416/97 R; 416/196 R; 415/115

(58) Field of Classification Search
USPC ..... 415/115; 416/96 R, 97 R, 196 R; 29/889.721
See application file for complete search history.

(56) References Cited

U.S. PATENT DOCUMENTS

| | | | | |
|---|---|---|---|---|
| 4,866,828 | A | 9/1989 | Fraser | |
| 5,257,908 | A * | 11/1993 | Ortolano | 416/190 |
| 5,511,948 | A | 4/1996 | Suzuki et al. | |
| 5,695,323 | A | 12/1997 | Pfeifer et al. | |
| 6,682,306 | B2 | 1/2004 | Murakami et al. | |
| 7,686,581 | B2 * | 3/2010 | Brittingham et al. | 416/97 R |
| 7,758,311 | B2 * | 7/2010 | Loehle et al. | 416/196 R |
| 8,540,488 | B2 * | 9/2013 | Marra | 416/190 |

FOREIGN PATENT DOCUMENTS

EP 36044 A * 9/1981

OTHER PUBLICATIONS

John Marra; U.S. Appl. No. 12/701,041, filed Feb. 5, 2010; entitled "Snubber Assembly for Turbine Blades."
Alexander Beeck; U.S. Appl. No. 12/637,066, filed Dec. 14, 2009; entitled "Turbine Blade Damping Device With Controlled Loading."
John Marra et al.; U.S. Appl. No. 12/637,106, filed Dec. 14, 2009; entitled "Turbine Blade Damping Device With Controlled Loading."

* cited by examiner

*Primary Examiner* — Ninh H Nguyen

(57) ABSTRACT

A turbine blade assembly in a turbine engine. The turbine blade assembly includes a turbine blade and a first snubber structure. The turbine blade includes an internal cooling passage containing cooling air. The first snubber structure extends outwardly from a sidewall of the turbine blade and includes a hollow interior portion that receives cooling air from the internal cooling passage of the turbine blade.

17 Claims, 7 Drawing Sheets

COOLED SNUBBER STRUCTURE FOR TURBINE BLADES

CROSS REFERENCE TO RELATED APPLICATIONS

This application is a Continuation-In-Part of U.S. patent application Ser. No. 12/701,041, filed Feb. 5, 2010 now U.S. Pat. No. 8,523,525, entitled "SNUBBER ASSEMBLY FOR TURBINE BLADES" by John Joseph Marra, the entire disclosure of which is incorporated by reference herein.

This invention was made with U.S. Government support under Contract Number DE-FC26-05NT42644 awarded by the U.S. Department of Energy. The U.S. Government has certain rights to this invention.

FIELD OF THE INVENTION

The present invention relates generally to a snubber assembly for turbine blades, and, more particularly, to a snubber assembly that includes a hollow interior portion that receives cooling air from a cooling passage in the turbine blade.

BACKGROUND OF THE INVENTION

A turbomachine, such as a steam or gas turbine is driven by a hot working gas flowing between rotor blades arranged along the circumference of a rotor so as to form an annular blade arrangement, and energy is transmitted from the hot working gas to a rotor shaft through the rotor blades. As the capacity of electric power plants increases, the volume of flow through industrial turbine engines has increased more and more and the operating conditions (e.g., operating temperature and pressure) have become increasingly severe. Further, the rotor blades have increased in size to harness more of the energy in the working gas to improve efficiency. A result of all the above is an increased level of stresses (such as thermal, vibratory, bending, centrifugal, contact and torsional) to which the rotor blades are subjected.

In order to limit vibrational stresses in the blades, various structures may be provided to the blades to form a cooperating structure between blades that serves to dampen the vibrations generated during rotation of the rotor. For example, mid-span snubber structures, such as cylindrical standoffs, may be provided extending from mid-span locations on the blades for engagement with each other. Two mid-span snubber structures are typically located at the same height on either side of a blade with their respective contact surfaces pointing in opposite directions. The snubber contact surfaces on adjacent blades are separated by a small space when the blades are stationary. However, when the blades rotate at full load and untwist under the effect of the centrifugal forces, snubber surfaces on adjacent blades come in contact with each other to dampen vibrations by friction at the contacting snubber surfaces.

SUMMARY OF THE INVENTION

In accordance with one aspect of the invention, a turbine blade assembly is provided in a turbine engine. The turbine blade assembly comprises a turbine blade and a first snubber structure. The turbine blade has a pressure sidewall and an opposed suction sidewall and includes an internal cooling passage containing cooling air. The first snubber structure extends outwardly from one of the pressure sidewall and the suction sidewall and includes a hollow interior portion that receives cooling air from the internal cooling passage of the turbine blade.

The first snubber structure may comprise at least one exit aperture formed therein, the exit aperture providing an outlet for the cooling air in the hollow interior portion.

The first snubber structure may extend from the turbine blade at an angle toward a central axis of the turbine engine.

A diameter of the first snubber structure may decrease as the first snubber structure extends away from the turbine blade.

The turbine blade assembly may further comprise a second snubber structure extending outwardly from the other of the pressure sidewall and the suction sidewall, the second snubber structure including a hollow interior portion that receives cooling air from the cooling passage of the turbine blade.

The turbine blade assembly may further comprise a passageway extending through the turbine blade from the internal cooling passage to the first snubber structure hollow interior portion, the passageway providing cooling air from the turbine blade internal cooling passage to the first snubber structure hollow interior portion.

The passageway may be formed through the turbine blade at an angle with respect to an axis defined by the first snubber structure.

The turbine blade assembly may further comprise a damming structure in the turbine blade near an intersection between the internal cooling passage and the passageway, the damming structure effecting a reduction in a velocity of the cooling air flowing through the internal cooling passage near an inner surface of the turbine blade that defines the internal cooling passage to effect an increased flow of cooling air into the passageway.

In accordance with another aspect of the invention, a turbine blade assembly is provided in a turbine engine. The turbine blade assembly comprises a turbine blade, a first snubber structure, and a first passageway. The turbine blade has a pressure sidewall and an opposed suction sidewall and includes an internal cooling passage containing cooling air. The first snubber structure extends outwardly from one of the pressure sidewall and the suction sidewall and includes a hollow interior portion. The first passageway extends through the turbine blade from the internal cooling passage to the hollow interior portion of the first snubber structure to provide cooling air from the turbine blade to the first snubber structure.

In accordance with another aspect of the invention, a method is provided of affixing a snubber assembly to a turbine blade of a turbine engine, the turbine blade including an internal cooling passage. A first bore is formed in one of a pressure sidewall and a suction sidewall of the turbine blade, the first bore in communication with the internal cooling passage of the turbine blade. A first snubber structure is bonded to the turbine blade such that a hollow interior portion of the first snubber structure is aligned with the first bore in the turbine blade to provide fluid communication between the internal cooling passage in the turbine blade and the hollow interior portion of the first snubber structure.

A bond joint where the first snubber structure is bonded to the turbine blade may be machined to remove any excess material from the bond joint.

Bonding the first snubber structure to the turbine blade may comprise inertia welding the first snubber structure to the turbine blade.

The first bore may be formed at an angle with respect to an axis of the first snubber structure that is to be bonded to the turbine blade.

A second bore may be formed in the other of the pressure sidewall and the suction sidewall of the turbine blade. A second snubber structure may be bonded to the turbine blade such that a hollow interior portion of the second snubber structure is aligned with the second bore in the turbine blade to provide fluid communication between the internal cooling passage in the turbine blade and the hollow interior portion of the second snubber structure.

The first snubber structure may be bonded to the turbine blade at an angle toward a central axis of the turbine engine.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
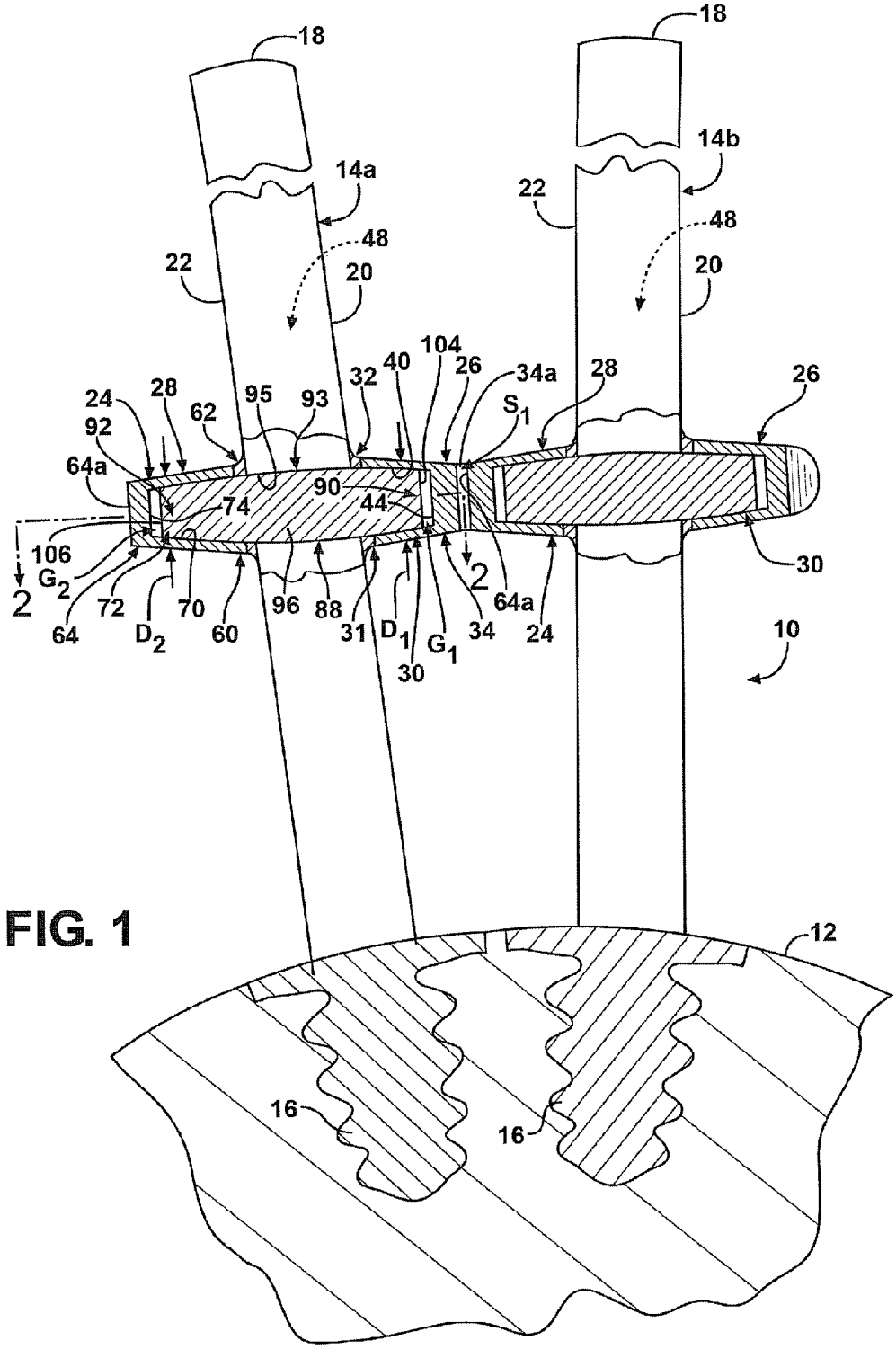
FIG. 1 is a partial end view of a rotor, as viewed in an axial flow direction, taken in a plane perpendicular to an axis of rotation and showing an embodiment of the invention.

Referring to FIG. 1, a section of a rotor 10 is illustrated for use in a turbomachine (not shown), such as for use in a gas or steam turbine engine. The rotor 10 comprises a rotor disc 12 and a plurality of blades 14, illustrated herein as a first blade 14*a* and an adjacent second blade 14*b*. The blades 14*a*, 14*b* comprise radially elongated structures extending from a blade root 16 engaged with the rotor disc 12, to a blade tip 18. Each of the blades 14*a*, 14*b* includes a pressure sidewall 20 and a suction sidewall 22 opposed form the pressure sidewall 20. Each of the blades 14*a*, 14*b* further includes a snubber assembly 24 located mid-span between the blade root 16 and the blade tip 18 of each of the blades 14*a*, 14*b*.

The snubber assembly 24 associated with the first blade 14*a* will now be described, it being understood that the snubber assemblies 24 of the other blades 14 are substantially identical to the snubber assembly 24 described herein. As most clearly shown in FIG. 4, the snubber assembly 24 comprises a first snubber structure 26, a second snubber structure 28, and a support structure 30. The first and second snubber structures 26, 28 may comprise a nickel based alloy, such as, for example, CM247-DS or PWA1483. The support structure 30 may also comprise a nickel based alloy, such as, for example, INCONEL 718 (INCONEL is a registered trademark of Special Metals Corporation, located in New Hartford, N.Y.) It is noted that the material selected for the first and second snubber structures 26, 28 preferably has good oxidation, corrosion, and/or creep resistance and the material selected for the support structure 30 is preferably a high strength material. It is also noted that it may be preferable to form both the first and second snubber structures 26, 28 and the blade 14*a* from the same/similar material, but to form the support structure 30 from a different material than the first and second snubber structures 26, 28 and the blade 14*a*. Hence, the material properties of these components can be closely matched to the requirements of the respective components. For example, since the support structure 30 is not directly exposed to the high temperature gases flowing through the engine, it need not have as good of oxidation, corrosion, and/or creep resistance as the first and second snubber structures 26, 28 and the blade 14*a*, which are directly exposed to the high temperature gases flowing through the engine. Moreover, since bending loads are transferred to the support structure 30, as will be discussed herein, the support structure 30 is preferably formed from a high strength material.

Figure 2:
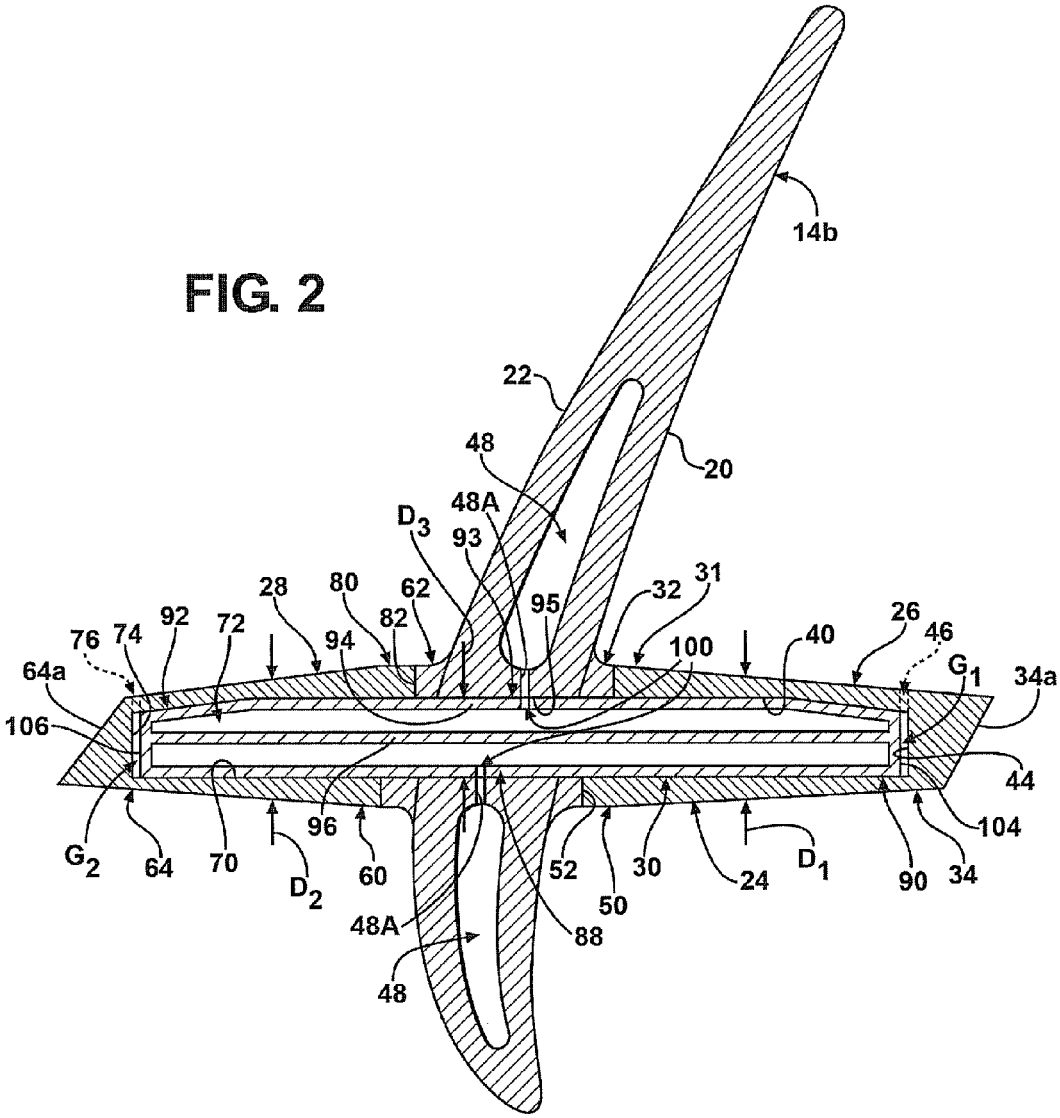
FIG. 2 is view taken on the plane indicated by the line 2-2 in FIG. 1.

Referring back to FIG. 1, the first snubber structure 26 is associated with and extends outwardly from the pressure sidewall 20 of the first blade 14*a* toward the suction sidewall 22 of the second blade 14*b*. As shown in FIGS. 1 and 2, the first snubber structure 26 includes a base portion 31 that is abutted against a first fillet 32, which first fillet 32 in the embodiment shown is integral with the pressure sidewall 20 of the first blade 14*a*. The first fillet 32 may act as a landing area for receiving the base portion 31 of the first snubber structure 26 during the assembly of the snubber assembly 24, as will be discussed in greater detail herein. In a preferred embodiment, the base portion 31 is in contact with but not affixed to the fillet 32, although the base portion 31 could be affixed to the fillet 32 if desired.

As shown in FIGS. 1 and 2, the first snubber structure 26 is a tapered cylindrical-shaped member having an outer diameter $D_1$ that decreases as the first snubber structure 26 extends away from the pressure sidewall 20, although it is understood that the first snubber structure 26 could have a generally constant outer diameter $D_1$ and could have other shapes as desired, such as, for example, elliptical, airfoil-shaped, etc.

An end portion 34 of the first snubber structure 26 in the embodiment shown defines a first angled surface 34*a*. The first angled surface 34*a* is spaced from a corresponding second angled surface 64*a* of a second snubber structure 28 of the adjacent second blade 14*b*, such that a first space $S_1$ is formed therebetween, see FIG. 1. As will be described below, during operation of the engine, as the blades 14 rotate they are "untwisted" slightly, such that the first angled surface 34*a* of the snubber assembly 24 of the first blade 14*a* comes into contact with the second angled surface 64*a* of the snubber assembly 24 of the second blade 14*b*.

Figure 4:
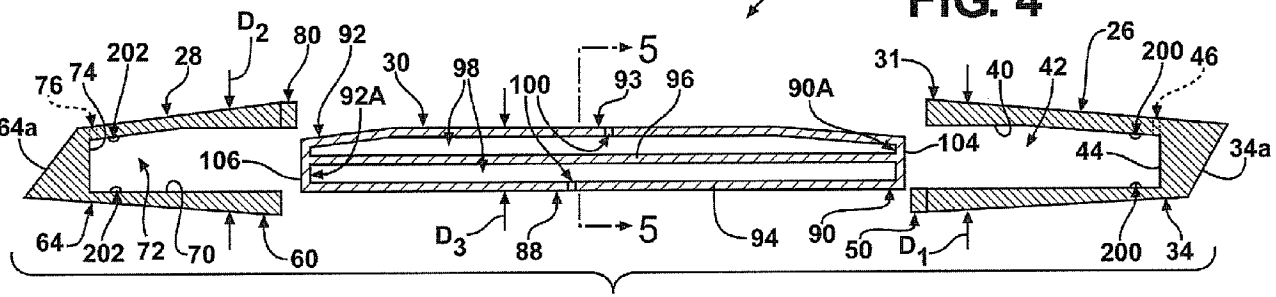
FIG. 4 is a view of the snubber assembly removed from the turbine blade of FIG. 3.

As shown in FIG. 4, the first snubber structure 26 includes an inner wall 40 that defines a hollow interior portion 42. The support structure 30 is received within the hollow interior portion 42 and affixed to the inner wall 40 as will be described in detail herein. The hollow interior portion 42 extends from the open end of the base portion 31 to an inner endwall 44 of the first snubber structure 26 that is located proximate to the end portion 34 thereof. It is noted that the inner endwall 44 could be located closer to the first blade 14*a* if desired, depending on the length of the support structure 30.

Referring to FIG. 4, the end portion 34 of the first snubber structure 26 includes a cooling fluid exit aperture 46 formed therein. The aperture 46 allows cooling fluid located in a first gap $G_1$, described below, to escape out of the first snubber structure 26. The cooling fluid may be provided into the first gap $G_1$ from the support structure 30, which support structure 30 may receive the cooling fluid from an interior cooling fluid channel 48 located within the first blade 14*a*, see FIG. 1. Additional details in connection with the cooling fluid in the support structure 30 will be discussed in detail herein. It is noted that the location and number of cooling fluid exit apertures 46 formed in the first snubber structure 26 may vary as desired.

Figure 3:
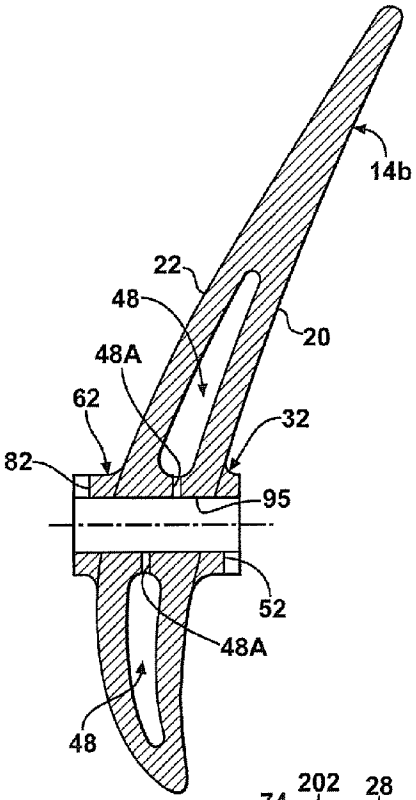
FIG. 3 is a view similar to that of FIG. 2 wherein a snubber assembly according an embodiment of the invention has been removed.

Referring to FIG. 2, the first snubber structure 26 includes antirotation structure 50, illustrated herein as an antirotation tab that extends outwardly from the base portion 31 toward the pressure sidewall 20 of the first blade 14*a*. The antirotation structure 50 is received in a corresponding indentation 52 formed in the fillet 32 (see also FIG. 3) such that the first snubber structure 26 is prevented from rotating with respect to the first blade 14*a* during operation of the engine.

Referring back to FIG. 1, the second snubber structure 28 is associated with and extends outwardly from the suction sidewall 22 of the first blade 14*a* toward the pressure sidewall (not shown) of an adjacent blade (not shown). As shown in FIGS. 1 and 2, the second snubber structure 28 includes a base portion 60 that is abutted against a second fillet 62, which second fillet 62 in the embodiment shown is integral with the suction sidewall 22 of the first blade 14*a*. The second fillet 62 may act as a landing area for receiving the base portion 60 of the second snubber structure 28 during the assembly of the snubber assembly 24, as will be discussed in greater detail herein. In the preferred embodiment, the base portion 60 is in contact with but not affixed to the fillet 62, although the base portion 60 could be affixed to the fillet 62 if desired.

As shown in FIGS. 1 and 2, the second snubber structure 28 is a tapered cylindrical-shaped member having an outer diameter $D_2$ that decreases as the second snubber structure 28 extends away from the suction sidewall 22, although it is understood that the second snubber structure 28 could have a generally constant outer diameter $D_2$ and could have other shapes as desired, such as, for example, elliptical, airfoil-shaped, etc.

An end portion 64 of the second snubber structure 28 in the embodiment shown defines a second angled surface 64*a*, which second angled surface 64*a* is spaced from a corresponding first angled surface (not shown) of an adjacent snubber structure (not shown) of an adjacent blade (not shown) such that a second space (similar to the first space $S_1$ discussed above) is formed therebetween.

As shown in FIG. 4, the second snubber structure 28 includes an inner wall 70 that defines a hollow interior portion 72. The support structure 30 is received within the hollow interior portion 72 and affixed to the inner wall 70 as will be described in detail herein. The hollow interior portion 72 extends from the open end of the base portion 60 to an inner endwall 74 of the second snubber structure 28 that is located proximate to the end portion 64 thereof. It is noted that the inner endwall 74 could be located closer to the first blade 14*a* if desired, depending on the length of the support structure 30.

Referring to FIG. 4, the end portion 64 of the second snubber structure 28 includes a cooling fluid exit aperture 76 formed therein. The aperture 76 allows cooling fluid located in a second gap $G_2$, described below, to escape out of the second snubber structure 28. The cooling fluid may be provided into the second gap $G_2$ from the support structure 30, which support structure 30 may receive the cooling fluid from the interior cooling fluid channel 48 located within the first blade 14*a*, as noted above. It is noted that the location and number of cooling fluid exit apertures 76 formed in the second snubber structure 28 may vary as desired.

As shown in FIG. 2, the second snubber structure 28 includes antirotation structure 80, illustrated herein as an antirotation tab that extends outwardly from the base portion 60 toward the suction sidewall 22 of the first blade 14*a*. The antirotation structure 80 is received in a corresponding indentation 82 formed in the fillet 62 (see also FIG. 3) such that the second snubber structure 28 is prevented from rotating with respect to the first blade 14*a* during operation of the engine.

Figure 5:
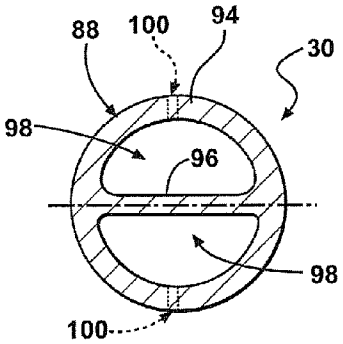
FIG. 5 is a view taken on the plane indicated by the line 5-5 in FIG. 4.

Referring to FIGS. 1, 2, 4, and 5, the support structure 30 comprises a generally cylindrical-shaped body member 88 having first and second tapered end portions 90, 92 and an intermediate portion 93 located between the first and second end portions 90, 92. As shown in FIG. 5, the body member 88 is defined by a generally cylindrical, outer wall 94 and a web member 96 that extends within the outer wall 94 to divide a hollow interior portion 98 of the body member 88. The web member 96 acts as an I-beam structure to provide structural rigidity to the support structure 30. As shown in FIGS. 1, 2, 4, and 5, the web member 96 extends in the radial direction, which improves load bearing of the support structure 30. In particular, the web member 96 and the hollow interior portion 98 provide a stiff and light support structure 30, which is used to bear centrifugal loads of the blade 14*a* during operation of the engine, as will be described in detail herein.

The intermediate portion 93 extends through a bore 95 formed in the blade 14*a* (see FIGS. 1-3), which bore 95 is formed through the blade 14*a* from the pressure sidewall 20 to the suction sidewall 22. The intermediate portion 93 is structurally coupled to the blade 14*a*, such as, for example, by shrink fitting the intermediate portion 93 of the support structure 30 into the bore 95 of the blade 14*a*, as will be described in detail herein. As shown in FIG. 2, an outer diameter $D_3$ of the intermediate portion 93 is substantially the same size as the bore 95 formed in the turbine blade 14*a*.

The hollow interior portion 98 of the body member 88 acts as a flow path for cooling fluid that enters the support structure 30 through one or more cooling fluid holes 100 (see FIGS. 2, 4, and 5) that are formed in the body member 88. The holes 100 provide fluid communication between respective passageways 48A that branch off from the interior cooling fluid channel 48 located within the first blade 14*a* and the hollow interior portion 98 of the body member 88. Specifically, the cooling fluid enters the interior cooling fluid channel 48 located within the first blade 14*a* and flows into the hollow interior portion 98 of the body member 88 through the passageways 48A and the holes 100, which holes 100 are aligned with the passageways 48A during assembly of the snubber assembly 24. The cooling fluid flowing within the hollow interior portion 98 of the body member 88 provides cooling to the support structure 30.

The end portions 90, 92 of the support structure 30 define respective openings 90A and 92A (see FIG. 4) so as to allow the cooling fluid in the hollow interior portion 98 of the body member 88 to flow out of the support structure 30 into the respective hollow interior portions 42, 72, where the cooling fluid can provide cooling to the first and second snubber structures 26, 28.

The first end portion 90 of the support structure 30 is received in the hollow interior portion 42 of the first snubber structure 26 and is coupled to the inner wall 40, such as by brazing or otherwise bonded, as will be discussed in greater detail herein. As shown in FIGS. 1, 2, and 4, the first end portion 90 is located in the hollow interior portion 42 of the first snubber structure 26 such that the first gap $G_1$ is formed between a first end surface 104 of the support structure 30 and the endwall 44 of the first snubber structure 26, which endwall 44 and the first end surface 104 of the support structure 30 face one another. The first gap $G_1$ provides a flow path for the cooling fluid in the hollow interior portion 98 of the support structure 30 to the cooling fluid exit aperture 46 formed in the first snubber structure 26 so as to allow the cooling fluid to flow out of the snubber assembly 24.

The second end portion 92 of the support structure 30 is received in the hollow interior portion 72 of the second snubber structure 28 and is coupled to the inner wall 70, such as by brazing or otherwise bonded, as will be discussed in greater detail herein. As shown in FIGS. 1, 2, and 4, the second end portion 92 is located in the hollow interior portion 72 of the second snubber structure 28 such that the second gap $G_2$ is formed between a second end surface 106 of the support structure 30 and the endwall 74 of the second snubber structure 28, which endwall 74 and the second end surface 106 of the support structure 30 face one another. The second gap $G_2$ provides a flow path for the cooling fluid in the hollow interior portion 98 of the support structure 30 to the cooling fluid exit aperture 76 formed in the second snubber structure 28 so as to allow the cooling fluid to flow out of the snubber assembly 24.

During operation of the engine, centrifugal forces are exerted on the first and second snubber structures 26, 28 as a result of the rotation of the rotor 10. These centrifugal forces cause the blades 14 to "untwist", which causes the first and second angled surfaces 34*a*, 64*a* of the respective snubber structures 26, 28 to move toward each other to engage each other with a damping force. It should be noted that it is desirable to configure the snubber structures 26, 28 to produce a damping force that is sufficient to produce damping at the interface between the snubber structures 26, 28 to control blade vibration.

As noted above, the damping forces create bending stresses, which, in prior art engines, are transferred from snubber structures to the blade pressure and suction sidewalls. However, according to aspects of the present invention, the majority of these bending stresses are transferred from the snubber structures 26, 28 to the support structure 30 and not to the blade pressure and suction sidewalls 20, 22, such that stresses exerted on the blade pressure and suction sidewalls 20, 22 are reduced.

Specifically, since the snubber structures 26, 28 are directly coupled to the support structure 30, the bending stresses exerted thereby are transferred from the snubber structures 26, 28 to the support structure 30 via the coupling of the support structure end portions 90, 92 to the inner walls 40, 70 of the respective snubber structures 26, 28. Thus, damage to the blades 14 as a result of bending stresses from the snubber structures 26, 28 is believed to be reduced, and a lifespan of the blades 14 is believed to be increased by the snubber assemblies 24. It is noted that, in the case of damage to or destruction of one or more of the components of the snubber assembly 24, the damaged portion(s) can be removed and replaced without requiring replacement of the entire blade 14.

Figure 6:
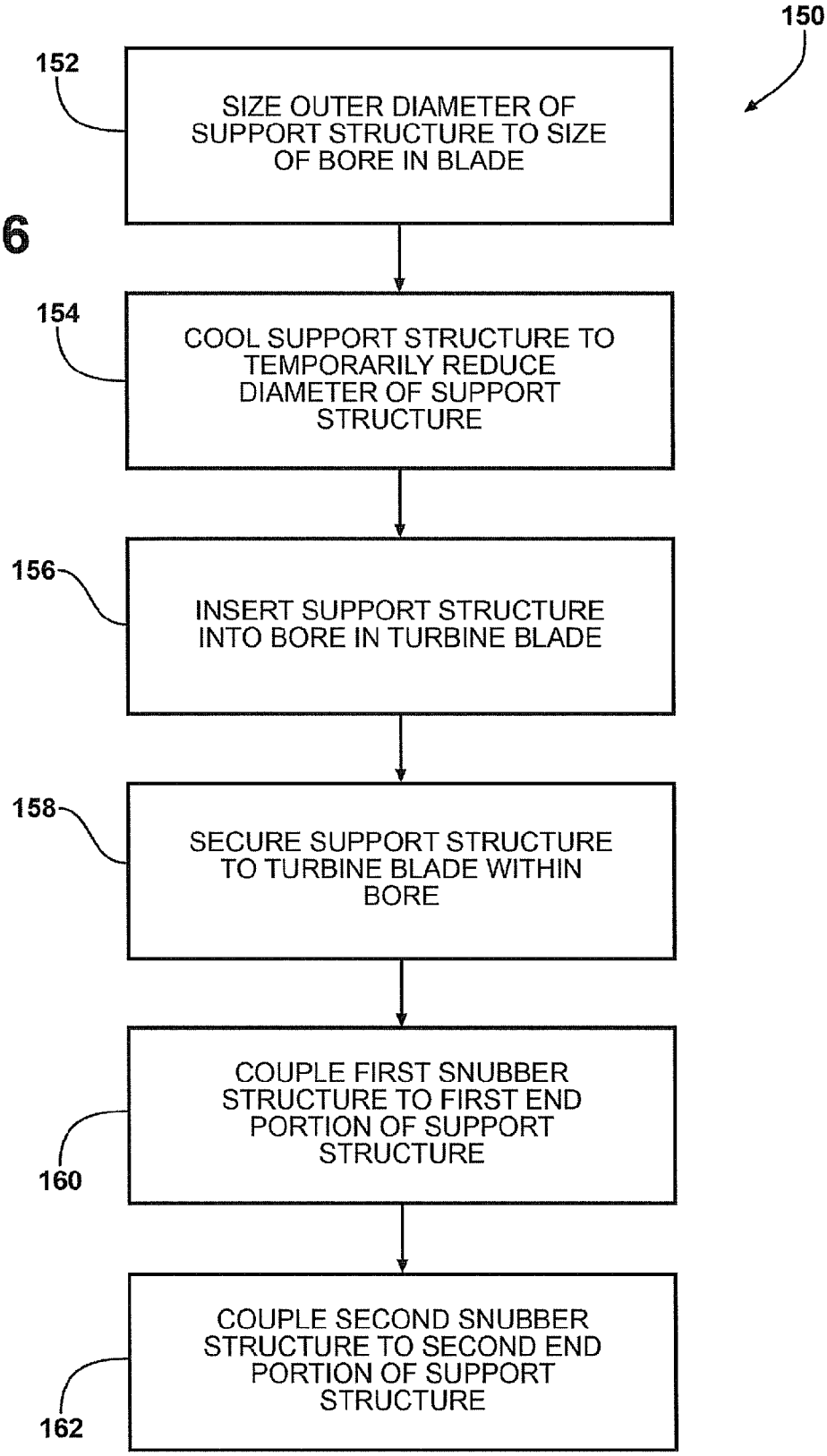
FIG. 6 is a flow chart illustrating exemplary steps for affixing a snubber assembly to a turbine blade according to an embodiment of the invention.

Referring now to FIG. 6, a method 150 is illustrated for affixing a snubber assembly, such as the snubber assembly 24 described above with reference to FIGS. 1-5, to a turbine blade having a bore formed therein, such as the blade 14*a* with the bore 95 discussed above.

At step 152, the outer diameter $D_3$ of the intermediate portion 93 of the support structure 30 is sized to be substantially the same size as the bore 95 in the turbine blade 14*a*. The outer diameter $D_3$ of the intermediate portion 93 of the support structure 30 may be sized, for example, by grinding the outer wall 94 of the support structure 30 down to the correct diameter $D_3$, e.g., by centerless grinding the intermediate portion 93.

After the outer diameter $D_3$ of the of the intermediate portion 93 of the support structure 30 is sized at step 152, the support structure 30 is cooled at step 154 to temporarily reduce the diameter $D_3$ of the intermediate portion 93 of the support structure 30, such that the support structure 30 can be inserted into the bore 95 formed in the turbine blade 14*a*. As one example, the support structure 30 may be disposed in liquid nitrogen to cool the support structure 30 down to a temperature of about −300° Fahrenheit.

Once the outer diameter $D_3$ of the support structure 30 is reduced by cooling at step 154, the support structure 30 is inserted into the bore 95 in the turbine blade 14*a* at step 156. The support structure 30 is inserted into the bore 95 in the turbine blade 14*a* such that the first end portion 90 of the support structure 30 extends outwardly from the turbine blade pressure sidewall 20 and the second end portion 92 of the support structure 30 extends outwardly from the turbine blade suction sidewall 22. Also, if cooling of the snubber assembly 24 is desired during engine operation, the support structure 30 may be inserted into the bore 95 in the turbine blade 14*a* such that holes 100 of the support structure 30 are aligned with passageways 48A that branch off from the interior cooling fluid channel 48 located within the blade 14*a*. Thus, cooling fluid provided to the interior cooling fluid channel 48 located within the blade 14*a* may flow into the hollow interior portion 98 of the support structure 30 to provide cooling to the snubber assembly 24 as discussed above.

It should be noted that, prior to insertion of the support structure 30 into the bore 95 at step 156, the support structure 30 may be turned to reduce at least a portion of the diameters $D_1$ and $D_2$ of the first and second end portions 90, 92 sufficiently to form a braze gap between the first and second end portions 90, 92 and the respective first and second snubber structures 24, 26 for receiving a brazing material.

The support structure 30 is then secured to the turbine blade 14*a* within the bore 95 at step 158. Securing the support structure 30 to the turbine blade 14*a* may comprise, for example, heating the support structure 30 such that the outer diameter $D_3$ thereof expands. Upon the expansion of the diameter $D_3$ of the support structure 30, the outer wall 94 thereof engages the turbine blade 14*a* to secure the support structure 30 to the turbine blade 14*a*, such that the support structure 30 is shrink fitted into the bore 95 of the turbine blade 14*a*. Heating the support structure 30 may comprise, for example, exposing the turbine blade 14*a* and the support structure 30 to the atmosphere and allowing the support structure 30 to heat up to atmospheric temperature. It is noted that the outer diameter $D_3$ of the support structure 30 may expand to the size of the bore 95 quite rapidly after the transition from cooling to heating, e.g., about 5-10 seconds, so it is desirable to insert the support structure 30 into the bore 95 quickly after the transition from cooling to heating. It is also noted that the support structure 30 could be heated up by inserting the turbine blade 14*a* and the support structure 30 into a heating device, such as a furnace.

At step 160, the first snubber structure 26 is coupled to the first end portion 90 of the support structure 30. Coupling the first snubber structure 26 to the first end portion 90 of the support structure 30 may comprise, for example locating a first brazing material 200 (see FIG. 4) in the hollow interior portion 42 of the first snubber structure 26 and/or on the first end portion 90 of the support structure 30 outside of the turbine blade 14*a*, and applying heat to melt the first brazing material 200. Upon a cooling of the first brazing material 200 it couples the first snubber structure 26 to the first end portion 90 of the support structure 30.

At step 162, which may be performed at the same time as step 160 or subsequent to or before step 160, the second snubber structure 28 is coupled to the second end portion 92 of the support structure 30. Coupling the second snubber structure 28 to the second end portion 92 of the support structure 30 may comprise, for example locating a second brazing material 202 (see FIG. 4) in the hollow interior portion 72 of the second snubber structure 28 and/or on the second end portion 92 of the support structure 30 outside of the turbine blade 14*a*, and applying heat to melt the second brazing material 202. Upon a cooling of the second brazing material 202 it couples the second snubber structure 28 to the second end portion 92 of the support structure 30.

In accordance with another embodiment, it may be desirable to couple one of the first or the second snubber structures 26, 28 to the support structure 30 before the support structure 30 is cooled at step 154. In this embodiment, the first or the second snubber structure 26, 28 coupled to the support structure 30 may be cooled at step 154 along with the support structure 30. Hence, when the support structure 30 is inserted into the bore 95 in the turbine blade 14*a* at step 156, the first or second snubber structure 26, 28 may act as a stop when the support structure 30 is inserted into the bore 95 the appropriate amount, i.e., the base portion 31 or 60 of the respective snubber structure 26 or 28 will contact the corresponding fillet 32, 62, such that the support structure 30 is not inserted too far through the bore 95.

Figure 7:
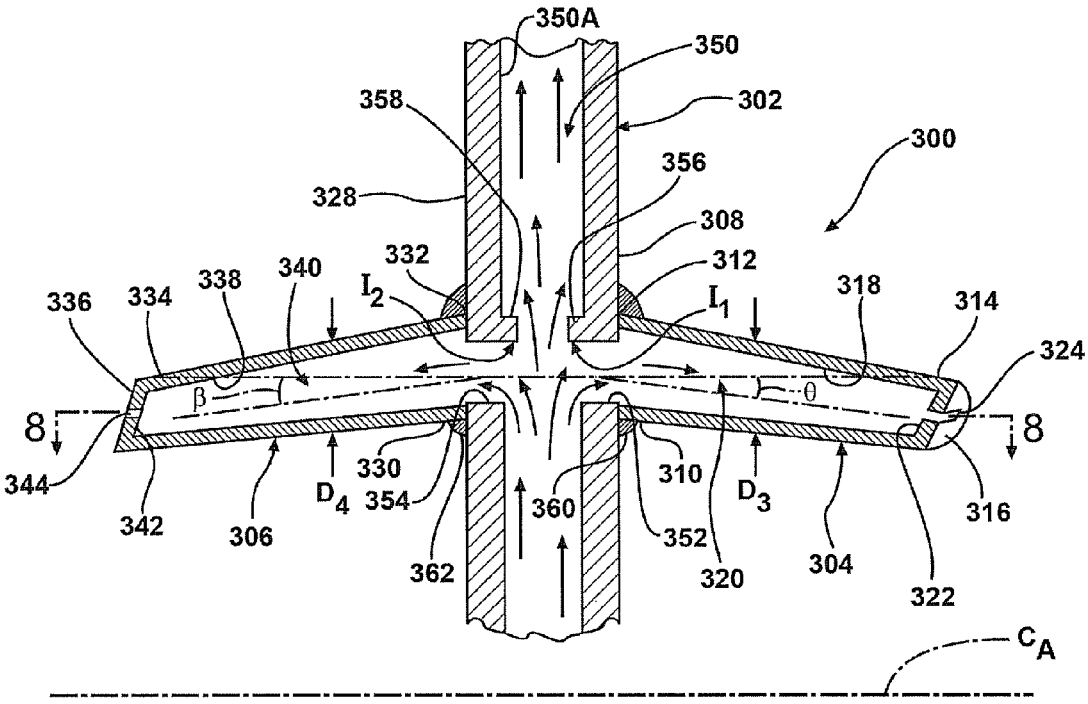
FIG. 7 is a side cross sectional view of a turbine blade including a snubber assembly according to another embodiment of the invention.
Figure 8:
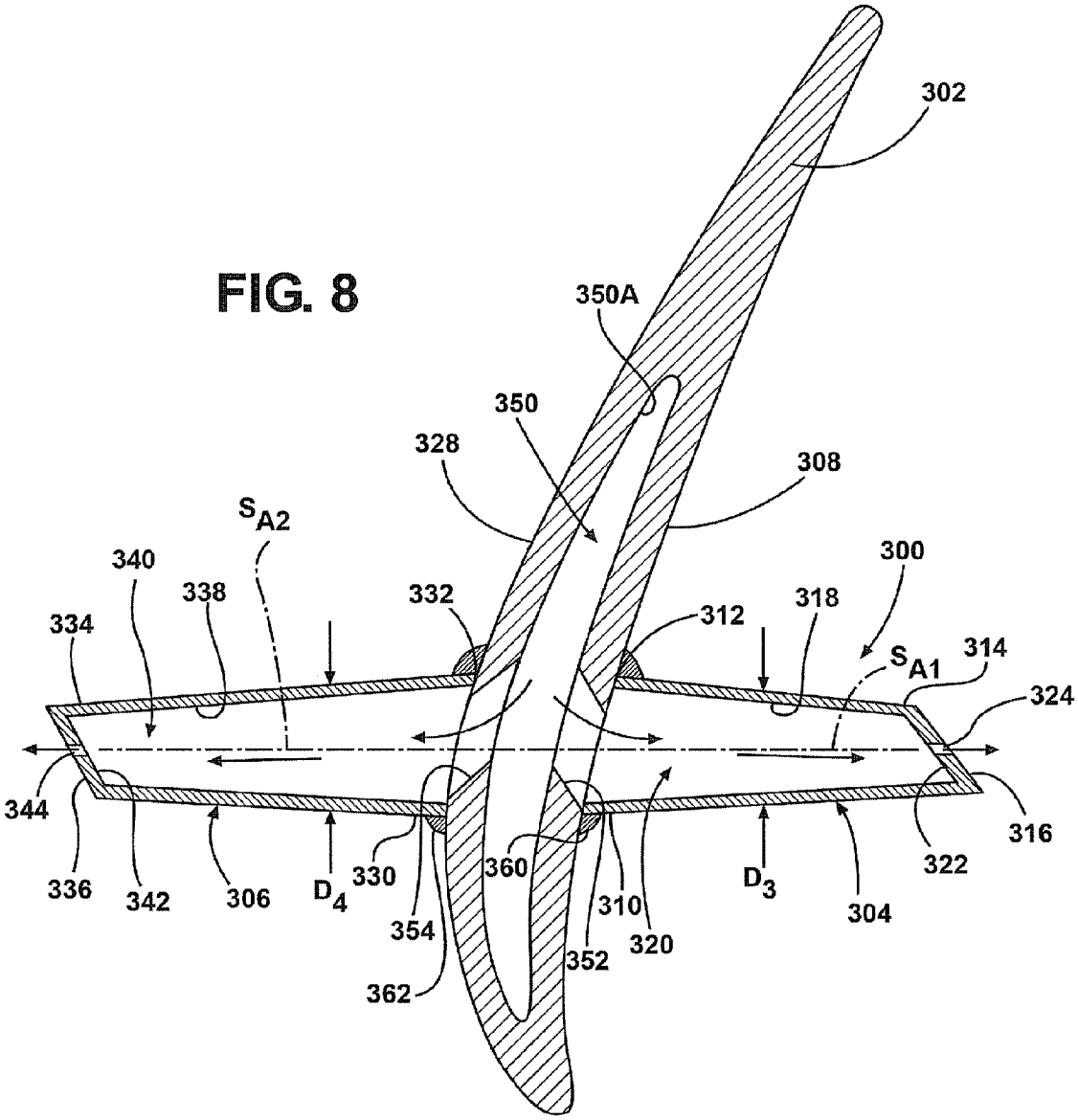
FIG. 8 is a cross sectional view taken along line 8-8 in FIG. 7.

Referring now to FIGS. 7 and 8, a snubber assembly 300 according to another embodiment of the present invention is illustrated. The snubber assembly 300 is associated with a blade 302 in a turbomachine, i.e., a turbine engine, as discussed above with reference to FIG. 1. The snubber assembly 300 comprises a first snubber structure 304 and a second snubber structure 306.

The first snubber structure 304 is associated with and extends outwardly from a pressure sidewall 308 of the blade 302 toward a suction sidewall of an adjacent blade (not shown in FIGS. 7 and 8). The first snubber structure 304 includes an open base portion 310 that is abutted against a first mating location 312 on the blade 302 and bonded to the blade 302.

The first snubber structure 304 is a tapered cylindrical-shaped member having an outer diameter $D_3$ that decreases as the first snubber structure 304 extends away from the pressure sidewall 308, although it is understood that the first snubber structure 304 could have a generally constant outer diameter $D_3$ and could have other shapes as desired, such as, for example, elliptical, airfoil-shaped, etc. As shown in FIG. 7, the first snubber structure 304 extends from the pressure sidewall 308 at an angle θ toward a central axis $C_A$ of the turbine engine. The angle θ may be about 5-10 degrees relative to the central axis $C_A$.

An end portion 314 of the first snubber structure 304 in the embodiment shown defines a first angled surface 316. The first angled surface 316 is spaced from a corresponding angled surface (not shown in FIGS. 7 and 8) of an adjacent snubber structure (not shown in FIGS. 7 and 8) of the adjacent blade, such that a first space is formed therebetween, as described above.

The first snubber structure 304 includes an inner wall 318 that defines a hollow interior portion 320 of the first snubber structure 304. The hollow interior portion 320 extends from the open base portion 310 to an inner endwall 322 of the first snubber structure 304 that is located proximate to the end portion 314 thereof.

The end portion 314 of the first snubber structure 304 includes at least one cooling fluid exit aperture 324 formed therein. The aperture 324 allows cooling fluid located in the hollow interior portion 320 to escape out of the first snubber structure 304, as will be described below. It is noted that the location and number of cooling fluid exit apertures 324 formed in the first snubber structure 304 may vary as desired.

The second snubber structure 306 is associated with and extends outwardly from a suction sidewall 328 of the blade 302 toward a pressure sidewall (not shown) of an adjacent blade (not shown). The second snubber structure 306 includes an open base portion 330 that is abutted against a second mating location 332 on the blade 302 and bonded to the blade 302.

The second snubber structure 306 is a tapered cylindrical-shaped member having an outer diameter $D_4$ that decreases as the second snubber structure 306 extends away from the suction sidewall 328, although it is understood that the second snubber structure 306 could have a generally constant outer diameter $D_4$ and could have other shapes as desired, such as, for example, elliptical, airfoil-shaped, etc. As shown in FIG. 7, the second snubber structure 306 extends from the suction sidewall 328 at an angle β toward the central axis $C_A$ of the turbine engine. The angle β may be about 5-10 degrees relative to the central axis $C_A$.

An end portion 334 of the second snubber structure 306 in the embodiment shown defines a second angled surface 336. The second angled surface 336 is spaced from a corresponding angled surface (not shown in FIGS. 7 and 8) of an adjacent snubber structure (not shown in FIGS. 7 and 8) of the adjacent blade, such that a second space is formed therebetween, as discussed above.

The second snubber structure 306 includes an inner wall 338 that defines a hollow interior portion 340 of the second snubber structure 306. The hollow interior portion 340 extends from the open base portion 330 to an inner endwall 342 of the second snubber structure 306 that is located proximate to the end portion 334 thereof.

The end portion 334 of the second snubber structure 306 includes at least one cooling fluid exit aperture 344 formed therein. The aperture 344 allows cooling fluid located in the hollow interior portion 340 to escape out of the second snubber structure 306, as will be discussed below. It is noted that the location and number of cooling fluid exit apertures 344 formed in the second snubber structure 306 may vary as desired.

As shown in FIGS. 7 and 8, the blade 302 comprises an inner surface 350A defining and internal cooling passage 350 extending therethrough. The internal cooling passage 350 receives cooling air, such as compressor discharge air, which cooling air cools the blade 302 during operation of the engine.

First and second bores 352, 354 are formed through the respective pressure and suction sidewalls 308, 328 of the blade 302. The bores 352, 354 are in fluid communication with the internal cooling passage 350 and define passageways for delivering cooling air from the internal cooling passage 350 to the hollow interior portions 320, 340 of the respective snubber structures 304, 306. As shown in FIG. 8, the bores 352, 354 may be formed through the blade 302 at an angle with respect to axes $S_{A1}$ and $S_{A2}$ defined by the respective first and second snubber structures 304, 306.

Referring to FIG. 7, each of the bores 352, 354 is associated with a respective first and second damming structure 356, 358 in the blade 302. The first damming structure 356 is located near a first intersection $I_1$ between the internal cooling passage 350 and the first bore 352, and the second damming structure 358 is located near a second intersection $I_2$ between the internal cooling passage 350 and the second bore 354. The damming structures 356, 358 effect a reduction in a velocity of the cooling air flowing through the internal cooling passage 350 near the inner surface 350A and the bores 352, 354 to effect an increased flow of cooling air into the passageways defined by the bores 352, 354. It is noted that other types of damming structures than the ones shown in FIG. 7 could be used to effect an increased flow of cooling air from the internal cooling passage 350 into the passageways defined by the bores 352, 354. Such other types of damming structures include, for example, spaced apart thin strips of material that extend along the pressure and suction sidewalls 308, 328 near the bores 352, 354.

During operation of the engine, the rotation of a rotor (not shown in FIGS. 7 and 8) causes corresponding rotation of the blade 302 (and other blades in the engine) and the snubber assembly 300, as discussed with reference to the turbomachine described above. The rotation causes the blade 302 to "untwist", which causes contact between the surfaces 316, 336 of the snubber structures 304, 306 with corresponding surfaces of adjacent blades, as described above.

Cooling air enters the internal cooling passage 350 located within the blade 302 and flows radially outwardly therethrough in the embodiment shown, as depicted by the line arrows illustrated in FIG. 7. As the cooling air flows through the internal cooling passage 350, the damming structures 356, 358 effect a reduction in a velocity of the cooling air flowing through the internal cooling passage 350 near the inner surface 350A and the bores 352, 354. The reduction in the velocity of the cooling air effects an increase in the amount of cooling air that flows into the passageways defined by the bores 352, 354 and into the hollow interior portions 320, 340 of the respective snubber structures 304, 306. The cooling fluid flowing within the hollow interior portions 320, 340 provides convective cooling to the respective snubber structures 304, 306. The spent cooling air may then exit the snubber structures 304, 306 through the exit apertures 324, 344.

The mass of the snubber assembly 300 is reduced as a result of the reduction in the diameters $D_3$ and $D_4$ of the snubber structures 304, 306 as they extend away from the blade 302, as compared to prior art snubber structures that have constant diameters. The mass of the snubber assembly 300 is further reduced as a result of the hollow interior portions 320 and 340 and the exit apertures 324, 344 in the inner endwalls 322, 342 of the respective snubber structures 304, 306. The reduction in mass reduces bending loads exerted by the snubber structures 304, 306 on the blade 302 at the mating locations 312, 332, which increases the lifespan of the blade 302. The reduction in the diameters $D_3$ and $D_4$ of the snubber structures 304, 306 also effects a shift in the center of mass of the snubber structures 304, 306 toward the blade 302. This shift in the center of mass of the snubber structures 304, 306 reduces the moment arm of the centrifugal loads of the snubber structures 304, 306, which further reduces bending loads exerted by the snubber structures 304, 306 on the blade 302 at the mating locations 312, 332. The radially inward angle of the snubber structures 304, 306 toward the central axis $C_A$ of the engine is believed to additionally reduce the bending loads exerted by the snubber structures 304, 306 on the blade 302 at the mating locations 312, 332. That is, the slight radially inward angle of the snubber structures 304, 306 creates an offset load as a result of the contact between the snubber structures 304, 306 and the adjacent snubber structures, which offset load produces a counter moment, which effects a reduction in the bending loads exerted by the snubber structures 304, 306 on the blade 302 at the mating locations 312, 332.

Figure 9:
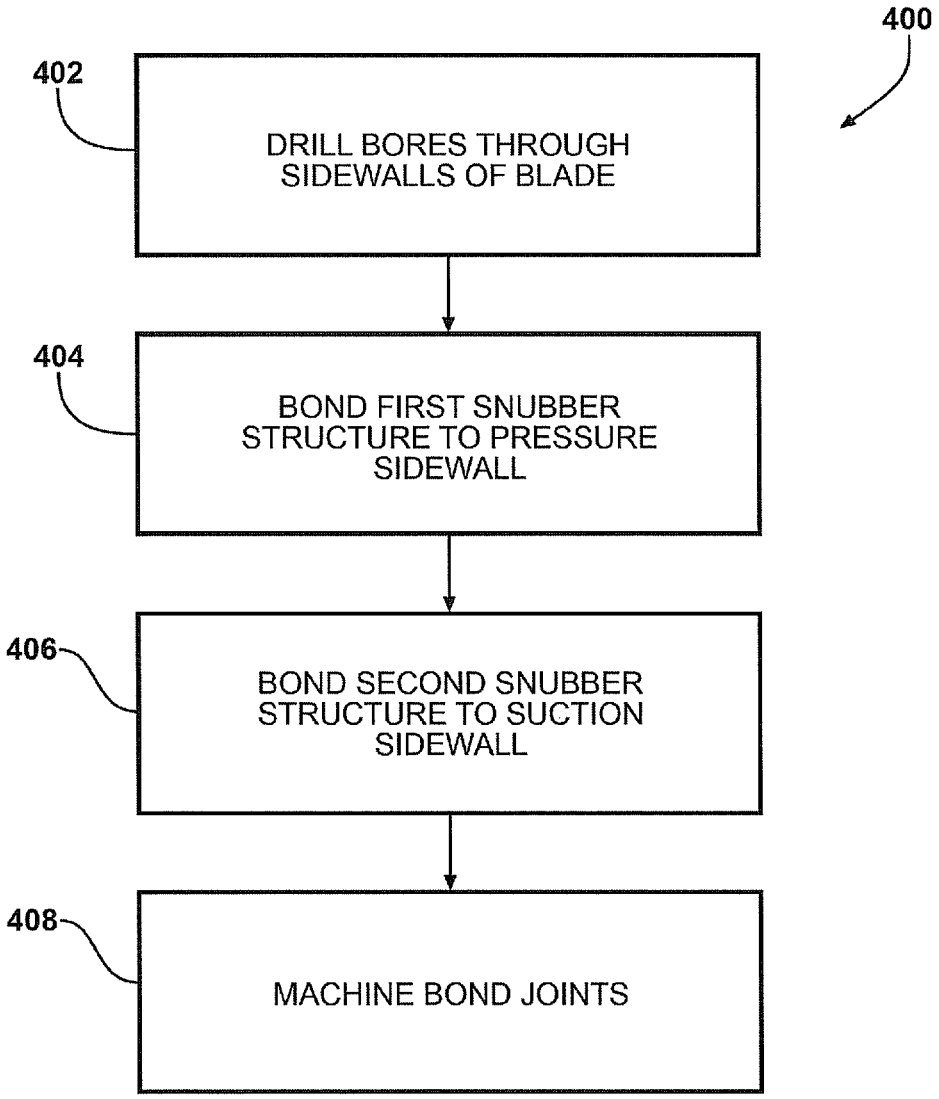
FIG. 9 is a flow chart illustrating exemplary steps for affixing a snubber assembly to a turbine blade according to an embodiment of the invention.

Referring now to FIG. 9, a method 400 is illustrated for affixing a snubber assembly, such as the snubber assembly 300 described above with reference to FIGS. 7 and 8, to a turbine blade having an internal cooling passage, such as the blade 302 of FIGS. 7 and 8.

At step 402, first and second bores 352, 354 are formed through the pressure and suction sidewalls 308, 328 of the blade 302. The bores 352, 354 are in fluid communication with the internal cooling passage 350 in the blade 302 and may be formed at an angle with respect to first and second snubber structures 304, 306 to be affixed to the blade 302.

At step 404, the first snubber structure 304 is bonded to the pressure sidewall 308 of the blade 302 by coupling the base portion 310 of the first snubber structure 304 to the first mating location 312. The bonding of the first snubber structure 304 to the pressure sidewall 308 may be performed, for example, by inertia welding. The first snubber structure 304 may be bonded to the blade 302 at an angle toward the central axis $C_A$ of the engine. During this step, the hollow interior portion 320 of the first snubber structure 304 is aligned with the first bore 352 to facilitate fluid communication between the internal cooling passage 350 of the blade 302 and the hollow interior portion 320 of the first snubber structure 304.

At step 406, the second snubber structure 306 is bonded to the suction sidewall 328 of the blade 302 by coupling the base portion 330 of the second snubber structure 306 to the second mating location 332. The bonding of the second snubber structure 306 to the suction sidewall 328 may be performed, for example, by inertia welding. The second snubber structure 306 may be bonded to the blade 302 at an angle toward the central axis $C_A$ of the engine. During this step, the hollow interior portion 340 of the second snubber structure 306 is aligned with the second bore 354 to facilitate fluid communication between the internal cooling passage 350 of the blade 302 and the hollow interior portion 340 of the second snubber structure 306.

At step 408, bond joints 360, 362, i.e., defined at locations where the first and second snubber structures 304, 306 are bonded to the blade 302, are machined to remove any excess material from the bond joints.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine blade assembly in a turbine engine comprising:

a turbine blade having a pressure sidewall and an opposed suction sidewall, said turbine blade including an internal cooling passage containing cooling air;

a first snubber structure extending outwardly from one of said pressure sidewall and said suction sidewall, said first snubber structure including a hollow interior portion that receives cooling air from said internal cooling passage of said turbine blade; and a passageway extending through said turbine blade from said internal cooling passage to said first snubber structure hollow interior portion, said passageway providing cooling air from said turbine blade internal cooling passage to said first snubber structure hollow interior portion, wherein said passageway is formed through said turbine blade at an angle with respect to an axis defined by said first snubber structure.

2. The turbine blade assembly of claim 1, wherein said first snubber structure comprises at least one exit aperture formed therein, said exit aperture providing an outlet for the cooling air in said hollow interior portion.

3. The turbine blade assembly of claim 1, wherein said first snubber structure extends from said turbine blade at an angle toward a central axis of the turbine engine.

4. The turbine blade assembly of claim 1, wherein a diameter of said first snubber structure decreases as said first snubber structure extends away from said turbine blade.

5. The turbine blade assembly of claim 1, further comprising a second snubber structure extending outwardly from the other of said pressure sidewall and said suction sidewall, said second snubber structure including a hollow interior portion that receives cooling air from said cooling passage of said turbine blade.

6. The turbine blade assembly of claim 1, further comprising a damming structure in said turbine blade near an intersection between said internal cooling passage and said passageway, said damming structure effecting a reduction in a velocity of the cooling air flowing through said internal cooling passage near an inner surface of said turbine blade that defines said internal cooling passage to effect an increased flow of cooling air into said passageway.

7. A turbine blade assembly in a turbine engine comprising:

a turbine blade having a pressure sidewall and an opposed suction sidewall, said turbine blade including an internal cooling passage containing cooling air;

a first snubber structure extending outwardly from one of said pressure sidewall and said suction sidewall, said first snubber structure including a hollow interior portion;

a first passageway extending through said turbine blade from said internal cooling passage to said hollow interior portion of said first snubber structure to provide cooling air from said turbine blade to said first snubber structure; and a damming structure in said turbine blade near an intersection between said internal cooling passage and said passageway, said damming structure effecting a reduction in a velocity of the cooling air flowing through said internal cooling passage to effect an increased flow of cooling air into said passageway.

8. The turbine blade assembly of claim 7, wherein said first snubber structure comprises at least one exit aperture formed therein, said exit aperture providing an outlet for the cooling air in said hollow interior portion.

9. The turbine blade assembly of claim 7, wherein said first snubber structure extends from said turbine blade at an angle toward a central axis of the turbine engine.

10. The turbine blade of assembly claim 9, wherein a diameter of said first snubber structure decreases as said first snubber structure extends away from said turbine blade.

11. The turbine blade assembly of claim 10, further comprising:

a second snubber structure extending outwardly from the other of said pressure sidewall and said suction sidewall, said second snubber structure including a hollow interior portion; and a second passageway extending through said turbine blade from said internal cooling passage to said second snubber structure hollow interior portion, said second passageway providing cooling air from said turbine blade internal cooling passage to said second snubber structure hollow interior portion.

12. A method of affixing at least one snubber structure to a turbine blade of a turbine engine, the turbine blade including an internal cooling passage, the method comprising:

forming a first bore in one of a pressure sidewall and a suction sidewall of the turbine blade, the first bore in communication with the internal cooling passage of the turbine blade; and bonding a first snubber structure to the turbine blade such that a hollow interior portion of the first snubber structure is aligned with the first bore in the turbine blade to provide fluid communication between the internal cooling passage in the turbine blade and the hollow interior portion of the first snubber structure.

13. The method of claim 12, further comprising machining a bond joint where the first snubber structure is bonded to the turbine blade to remove any excess material from the bond joint.

14. The method of claim 12, wherein bonding the first snubber structure to the turbine blade comprises inertia welding the first snubber structure to the turbine blade.

15. The method of claim 12, wherein forming a first bore in one of a pressure sidewall and a suction sidewall comprises forming the first bore at an angle with respect to an axis of the first snubber structure that is to be bonded to the turbine blade.

16. The method of claim 12, further comprising:

forming a second bore in the other of the pressure sidewall and the suction sidewall of the turbine blade; and bonding a second snubber structure to the turbine blade such that a hollow interior portion of the second snubber structure is aligned with the second bore in the turbine blade to provide fluid communication between the internal cooling passage in the turbine blade and the hollow interior portion of the second snubber structure.

17. The method of claim 12, wherein bonding a first snubber structure to the turbine blade comprises bonding the first snubber structure to the turbine blade at an angle toward a central axis of the turbine engine.

* * * * *